US005222370A

United States Patent [19]

James

[11] Patent Number: 5,222,370

[45] Date of Patent: Jun. 29, 1993

[54] AUTOMATIC CHILLER STOPPING SEQUENCE

[75] Inventor: Paul W. James, Windsor, Conn.

[73] Assignee: Carrier Corporation, Syracuse, N.Y.

[21] Appl. No.: 822,226

[22] Filed: Jan. 17, 1992

[51] Int. Cl.[5] ..... F25B 7/00

[52] U.S. Cl. ..... 62/175; 62/201; 62/230; 236/1 EA

[58] Field of Search ..... 62/175, 201, 230; 236/1 EA; 417/7

[56] References Cited

U.S. PATENT DOCUMENTS

| | | | |
|---|---|---|---|
| 4,152,902 | 5/1979 | Lush | 236/1 EA |
| 4,210,957 | 7/1980 | Spethmann | 62/175 |
| 4,384,462 | 5/1983 | Overman et al. | 236/1 EA |
| 4,463,574 | 8/1984 | Spethmann et al. | 236/1 EA |
| 4,483,152 | 11/1984 | Bitondo | 62/175 |
| 4,487,028 | 12/1984 | Foye | 62/175 |
| 4,633,672 | 1/1987 | Persem et al. | 62/175 |
| 4,646,530 | 3/1987 | Huenniger | 62/230 |
| 5,050,397 | 9/1991 | Sugiyama et al. | 62/175 |

FOREIGN PATENT DOCUMENTS

| | | | |
|---|---|---|---|
| 0169966 | 6/1990 | Japan | 62/230 |
| 2176312 | 12/1986 | United Kingdom | 62/201 |

*Primary Examiner*—John K. Ford

[57] ABSTRACT

A control for a multiple chiller refrigeration system whereby a chiller can be stopped at a predetermined load in order that the remaining building load can be picked up by the remaining running chillers without exceeding set load capacities of the running chillers.

5 Claims, 2 Drawing Sheets

AUTOMATIC CHILLER STOPPING SEQUENCE

BACKGROUND OF THE INVENTION

1. Field of the Invention

The present invention relates to methods of operating and control systems for air conditioning systems and, more particularly, to a method of operating and a control system for control devices in multiple vapor compression refrigeration systems (chillers) whereby chillers can be stopped at a predetermined load in order that the remaining building load can be picked up by the remaining running chillers without exceeding set load capacities of the running chillers.

2. Description of Related Art

Generally, large commercial air conditioning systems include a chiller which consists of an evaporator, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water or glycol, which is circulated to a remote location to satisfy a cooling load. The refrigerant in the evaporator evaporates as it absorbs heat from the heat transfer fluid flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

To maximize the operating efficiency of a chiller plant, it is desirable to match the amount of work done by the compressor to the work: needed to satisfy the cooling load placed on the air conditioning system. Commonly, this is done by capacity control means which adjust the amount of refrigerant vapor flowing through the compressor. The capacity control means may be a device for adjusting refrigerant flow in response to the temperature of the chilled heat transfer fluid leaving the coil in the evaporator. When the evaporator chilled heat transfer fluid temperature decreases, indicating a reduction in refrigeration load on the refrigeration system, a throttling device, e.g. guide vanes, closes, thus decreasing the amount of refrigerant vapor flowing through the compressor drive motor. This decreases the amount of work that must be done by the compressor thereby decreasing the amount of power draw (KW) on the compressor. At the same time, this has the effect of increasing the temperature of the chilled heat transfer fluid leaving the evaporator. In this manner, the compressor operates to maintain the temperature of the chilled heat transfer fluid leaving the evaporator at, or within a certain range of, a setpoint temperature.

Large commercial air conditioning systems, however, typically comprise a plurality of chillers, with one designated as the "Lead" chiller (i.e. the chiller that is started first) and the other chillers designated as "Lag" chillers. The designation of the chillers changes periodically depending on such things as run time, starts, etc. The total chiller plant is sized to supply maximum design load. For less than design loads, the choice of the proper number of chillers to meet the load condition has a significant impact on total plant efficiency and reliability of the individual chillers. In order to maximize plant efficiency and reliability it is necessary to stop selected chillers under low load conditions, and insure that all remaining chillers have a balanced load. The relative electrical energy input to the compressor motors (% KW) necessary to produce a desired amount of cooling is one means of determining the loading and balancing of a plurality of running compressors. In the prior art, however, when the building load decreased and the chillers changed capacity to follow the building load, a selected chiller was manually stopped by an operator when the total load estimated by the operator on the system dropped below the total estimated capacity of the running chillers by an amount equal to the estimated capacity of the chiller to be stopped. However, subsequent slight increases in building load required the previously stopped chiller to be started again. This stopping and starting chillers has a very detrimental effect on the efficiency and reliability of the chillers. Thus, there exists a need for a method and apparatus which determines when a chiller can be stopped so that the remaining chillers can pick up the remaining building load and which minimizes the disadvantages of the prior control methods.

SUMMARY OF THE INVENTION

Therefore, it is an object of the present invention to provide a simple, efficient, and effective system for controlling the stopping of chillers in a refrigeration system in response to a decrease in load conditions.

It is another object of the present invention to provide a reduced chiller capacity setpoint that is controlled by a combination of running chiller capacities, the capacity of the next chiller to be stopped, additional cooling required setpoint, and reduced cooling required setpoint.

These and other objects of the present invention are attained by a chiller stopping control system for a refrigeration system comprising means for generating a % KW setpoint signal at which a chiller can be stopped and the remaining load picked up by the remaining chillers, without exceeding a target % KW setpoint which is below a desired % KW setpoint for starting an additional chiller, which prevents short-cycling or restarting a recently stopped chiller.

A Lag compressor can be stopped when the average % KW power draw (approximated by motor current) of all running compressors: is at or below a calculated % KW to meet a reduced cooling requirement. The calculated Reduced Cooling Required (% KW) setpoint is the % KW at which a Lag compressor can be stopped and the building load picked up by the remaining chillers, without exceeding a target % KW setpoint below the % KW setpoint where an additional chiller would be required. The Reduced Cooling Required (% KW) setpoint is determined as follows:

$$RCR\ (\%\ KW)\ SP = \frac{[\text{Chiller Cap. } (N-1)] \times (ACR\ SP - RCR \text{ Hysteresis})}{\text{Total Running Chiller Cap. } (N)}$$

where Chiller Capacity (N−1) is the capacity of the running chillers minus the next chiller to be stopped, Total Running Chiller Capacity (N) is the capacity of the running chillers, ACR setpoint is the setpoint where an additional chiller would be required and, RCR Hysteresis is a target value below ACR setpoint.

BRIEF DESCRIPTION OF THE DRAWINGS

Still other objects and advantages of the present invention will be apparent from the following detailed description of the present invention in conjunction with the accompanying drawing, in which the reference numerals designate like or corresponding parts throughout the same, in which.

DESCRIPTION OF THE PREFERRED EMBODIMENT

Figure 1:
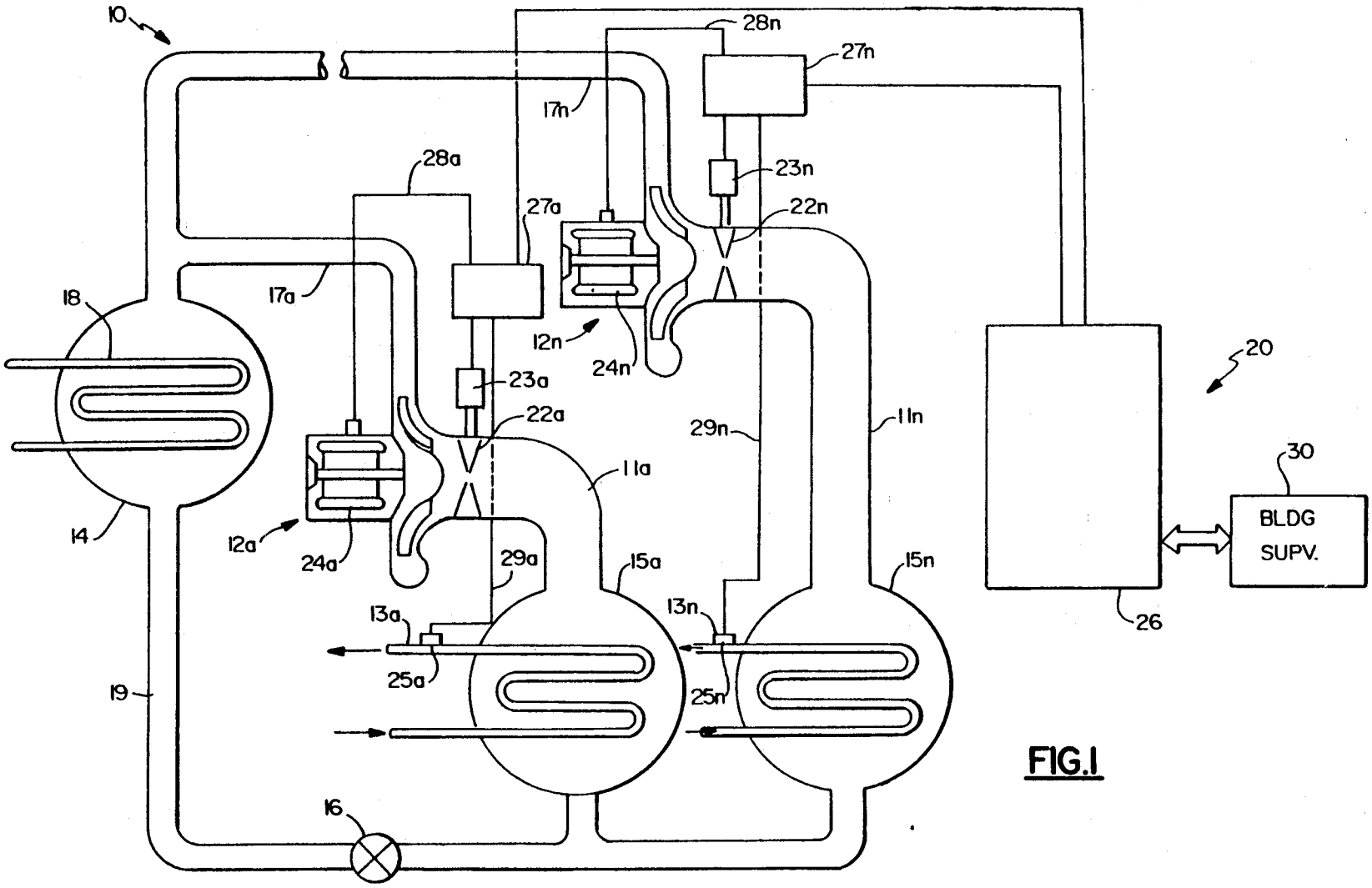
FIG. 1 is a schematic illustration of a multiple compressor chilled water refrigeration system with a control system for balancing the relative power draw on each operating compressor according to the principles of the present invention.

Referring to FIG. 1, a vapor compression refrigeration system 10 is shown having a plurality of centrifugal compressors 12*a–n* with a control system 20 for varying the capacity of the refrigeration system 10 and for stopping compressors according to the principles of the present invention. As shown in FIG. 1, the refrigeration system 10 includes a condenser 14, a plurality of evaporators 15*a–n* and a poppet valve 16. In operation, compressed gaseous refrigerant is discharged from one or a number of compressors 12*a–n* through compressor discharge lines 17*a–n* to the condenser wherein the gaseous refrigerant is condensed by relatively cool condensing water flowing through tubing 18 in the condenser 14. The condensed liquid refrigerant from the condenser 14 passes through the poppet valve 16 in refrigerant line 19, which forms a liquid seal to keep condenser vapor from entering the evaporator and to maintain the pressure difference between the condenser and the evaporator. The liquid refrigerant in the evaporator 15*a–n* is evaporated to cool a heat transfer fluid, such as water or glycol, flowing through tubing 13*a–n* in the evaporator 15*a–n*. This chilled heat transfer fluid is used to cool a building or space, or to cool a process or other such purposes. The gaseous refrigerant from the evaporator 15*a–n* flows through the compressor suction lines 11*a–n* back to the compressors 12*a–n* under the control of compressor inlet guide vanes 22*a–n*. The gaseous refrigerant entering the compressor 12*a–n* through the guide vanes 22*a–n* is compressed by the compressor 12*a–n* through the compressor discharge line 17*a–n* to complete the refrigeration cycle. This refrigeration cycle is continuously repeated during normal operation of the refrigeration system 10.

Each compressor has an electrical motor 24*a–n* and inlet guide vanes 22*a–n*, which are opened and closed by guide vane actuator 23*a–n*, controlled by the operating control system 20. The operating control system 20 may include a chiller system manager 26, a local control board 27*a–n* for each chiller, and a Building Supervisor 30 for monitoring and controlling various functions and systems in the building. The local control board 27*a–n* receives a signal from temperature sensor 25*a–n*, by way of electrical line 29*a–n*, corresponding to the temperature of the heat transfer fluid leaving the evaporators 15*a–n* through the tubing 13*a–n* which is the chilled water supply temperature to the building. This leaving chilled water temperature is compared to the desired leaving chilled water temperature setpoint by the Chiller System Manager 26 which generates a leaving chilled water temperature setpoint which is sent to the chillers 12*a–n* through the local control board 27*a–n*. Preferably, the temperature sensor 25*a–n* is a temperature responsive resistance devices such as a thermistor having its sensor portion located in the heat transfer fluid in the leaving water supply line 13*a–n*. Of course, as will be readily apparent to one of ordinary skill in the art to which the present invention pertains, the temperature sensor may be any variety of temperature sensors suitable for generating a signal indicative of the temperature of the heat transfer fluid in the chilled water lines.

The chiller system manager 20 may be any device, or combination of devices, capable of receiving a plurality of input signals, processing the received input signals according to preprogrammed procedures, and producing desired output controls signals in response to the received and processed input signals, in a manner according to the principles of the present invention.

Further, preferably, the Building Supervisor 30 comprises a personal computer which serves as a data entry port as well as a programming tool, for configuring the entire refrigeration system and for displaying the current status of the individual components and parameters of the system;

Still further the local control board 27*a–n* includes a means for controlling the inlet guide vanes for each compressor. The inlet guide vanes are controlled in response to control signals sent by the chiller system manager. Controlling the inlet guide vanes controls the KW demand of the electric motors 24 of the compressors 12. Further, the local control boards receive signals from the electric motors 23 by way of electrical line 28*a–n* corresponding to amount of power draw (approximated by motor current) as a percent of full load kilowatts (% KW) used by the motors.

Figure 2:
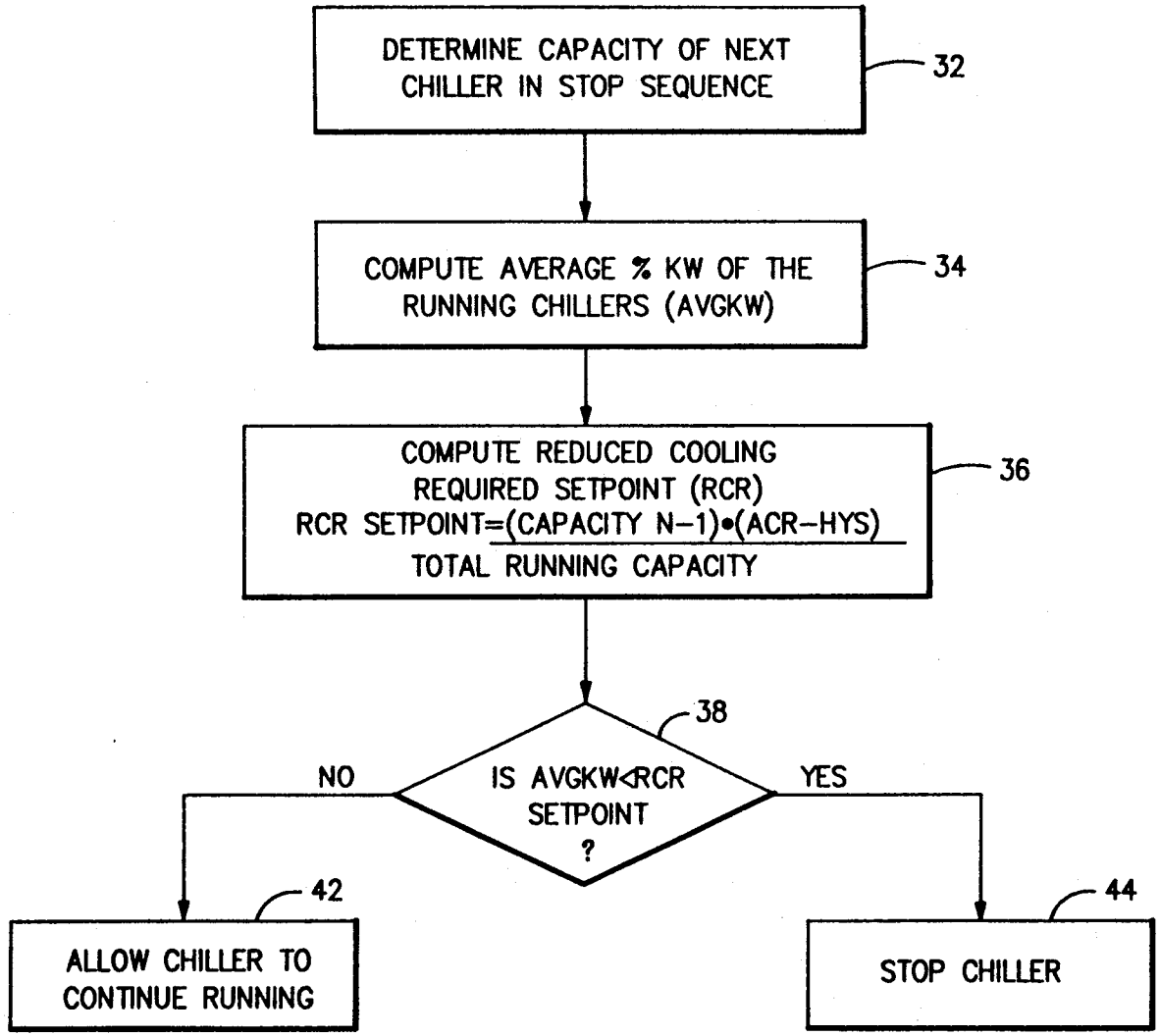
FIG. 2 is a flow diagram of the control system of the present invention.

Referring now specifically to FIG. 2 for details of the operation of the control system there is shown a flow chart of the logic used to determine when to stop a lag compressor in accordance with the present invention. The flow chart includes capacity determination 32 of the next lag chiller in the stop sequence from which the logic flows to step 34 to compute the average % KW of all running chillers (AVGKW). The logic then proceeds to step 36 to compute the Reduced Cooling Required Setpoint according to the following:

$$RCR\ \text{Setpoint} = \frac{(\text{Chiller Capacity } N-1) \times (ACR - HYS)}{\text{Total Running Capacity}}$$

Where:

Chiller Capacity N−1 is the sum of the capacities of the currently running chillers minus the capacity of the next chiller in stop sequence, ACR is the Additional Cooling Required which is a programmable KW value which AVGKW must be above before the next chiller is started, HYS is the Hysteresis which is a programmable % KW value subtracted from ACR to determine a target for AVGKW after the next chiller is stopped, and Total Running Capacity is the sum of the capacities of all chillers currently running.

At step 38 the AVGKW is compared to RCR Setpoint, and if the AVGKW is not less than the RCR Setpoint the next chiller in the stop sequence is allowed to continue running in Step 42.

If the answer to Step 38 is Yes, then the logic flows to step 44 to stop the next chiller.

While this invention has been described with reference to a particular embodiment disclosed herein, it is not confined to the details setforth herein and this application is intended to cover any modifications or changes as may come within the scope of the invention.

I claim:

1. A method of controlling when to stop a compressor in a multiple compressor refrigeration system including a motor for driving each compressor comprising the steps of:

determining the capacity of the next compressor to be stopped;

determining the capacity of all currently running compressors;

determining a reduced cooling requirement (RCR) setpoint for stopping said compressor based upon the determined capacity of the next compressor to be stopped and the determined capacity of all currently running compressors;

comparing said reduced cooling requirement setpoint with an average power draw of all running chillers; and stopping said next compressor when the comparison of said reduced cooling requirement setpoint is greater than said average power draw of all currently running compressors.

2. A method as setforth in claim 1 wherein the step of determining said reduced cooling requirement setpoint is calculated by solving the equation:

$$RCR\ \text{Setpoint} = \frac{(\text{Chiller Capacity } N-1) \cdot (ACR - HYS)}{\text{Total Running Capacity}}$$

where Chiller Capacity N−1 is the sum of the capacities of the currently running chillers minus the capacity of the next chiller to be stopped, ACR is the Additional Cooling Required which is a programmable value which the average power draw must be above before the next chiller is started, HYS is the Hysteresis which is a programmable value subtracted from ACR to determine a target for the average power draw after the next chiller is stopped, and Total Running Capacity is the sum of the capacities of all chillers currently running.

3. A method as setforth in claim 2 wherein ACR. and HYS is the power draw in kilowatts of the respective compressor motors.

4. A control device for controlling when to stop a compressor of a multiple compressor refrigeration system including a motor for driving each compressor comprising:

a capacity determining means for determining the capacity of the next compressor to be stopped;

a capacity measuring means for measuring the output of the currently running compressor;

a reduced cooling requirement setpoint calculation means responsive to said capacity determining means and said capacity measuring means for calculating a reduced capacity (RCR) setpoint which will satisfy a space load upon stopping said next compressor; and a comparison means for comparing the average power draw of the currently running compressor (AVGKW) with said reduced capacity setpoint (RCR) wherein said next compressor is stopped when the average power draw of the currently running compressors is less than or equal to said reduced capacity setpoint.

5. A control device as setforth in claim 4 wherein said reduced cooling requirement setpoint calculation means calculates the reduced capacity (RCR) setpoint according to the relationship:

$$RCR\ \text{Setpoint} = \frac{(\text{Chiller Capacity } N-1) \times (ACR - HYS)}{\text{Total Running Capacity}}$$

where, Chiller Capacity N−1 is the sum of the capacities of the currently running chillers minus the capacity of the next chiller to be stopped, ACR is the Additional Cooling Required which is a programmable value which AVGKW must be above before the next chiller is started, HYS is the Hysteresis which is a programmable value subtracted from ACR to determine a target for AVGKW after the next chiller is stopped, and Total Running Capacity is the sum of the capacities of all chillers currently running.

* * * * *